US007462133B1

(12) United States Patent
Herman et al.

(10) Patent No.: US 7,462,133 B1
(45) Date of Patent: Dec. 9, 2008

(54) FOREARM AND WRIST EXERCISE DEVICE

(76) Inventors: Richard L. Herman, 419 Red Coat Ct., Waterford, WI (US) 53185; Gordon H. Smith, 5635 Charles St., Racine, WI (US) 53402

( * ) Notice: Subject to any disclaimer, the term of this patent is extended or adjusted under 35 U.S.C. 154(b) by 0 days.

(21) Appl. No.: 12/043,307

(22) Filed: Mar. 6, 2008

Related U.S. Application Data

(63) Continuation-in-part of application No. 10/826,714, filed on Apr. 16, 2004, now Pat. No. 7,351,186.

(51) Int. Cl.
*A63B 21/22* (2006.01)
*A66B 15/02* (2006.01)

(52) U.S. Cl. ..... 482/46; 482/44; 482/1

(58) Field of Classification Search ..... 482/1–7, 482/44–49, 148
See application file for complete search history.

(56) References Cited

U.S. PATENT DOCUMENTS 4,060,241 A * 11/1977 Hegel ..... 482/60
4,239,208 A 12/1980 Walls
4,703,188 A * 10/1987 Gottfried ..... 290/38 B
5,256,115 A * 10/1993 Scholder et al. ..... 482/6
5,634,871 A 6/1997 Froelich, Sr. et al.
2005/0200221 A1* 9/2005 Vasilovich et al. ..... 310/156.37
2006/0189452 A1 8/2006 Chou

* cited by examiner

*Primary Examiner*—Steve R Crow
(74) *Attorney, Agent, or Firm*—Donald J. Ersler

(57) ABSTRACT

A forearm and wrist exercise device includes a base frame, a handle rod, a driver wheel, a driven yoke, a driven wheel and an adjustable tensioner. The base frame is attached to a stationary object, such as a wall. The handle rod extends from the driver wheel and the handle rod is pivotally retained by the base frame. The driven wheel is forced against the driver wheel. A second embodiment of the forearm and wrist exercise device includes a base frame, a handle rod, a driver wheel, a tension belt and an adjustable tensioner. A third embodiment of the forearm and wrist exercise device includes a base frame, a hydraulic pump, a hydraulic flow valve and a pair of extension shafts. A fourth embodiment of the forearm and wrist exercise device includes a base frame, a handle rod, a driver gear, a driven gear, a flywheel and an electromagnet.

13 Claims, 8 Drawing Sheets

10
12
14
16
18
20
22
24
26
32
34
36
38
2
2
1

FOREARM AND WRIST EXERCISE DEVICE

CROSS-REFERENCES TO RELATED APPLICATIONS

This is a continuation-in-part patent application taking priority from nonprovisional application Ser. No. 10/826,714 filed on Apr. 16, 2004 now U.S. Pat. No. 7,351,186.

BACKGROUND OF THE INVENTION

1. Field of the Invention

The present invention relates generally to exercise devices and more specifically to a forearm and wrist exercise device, which builds muscle mass in forearms, wrists and hands.

2. Discussion of the Prior Art

There are numerous devices, which may be used to strengthen the muscles in forearms, wrists and hands. U.S. Pat. No. 4,239,208 to Walls discloses a wrist and forearm conditioner and exerciser. The Walls patent includes a handle that becomes tensioned as thereof is rotated. U.S. Pat. No. 5,634,871 to Froelich, Sr. et al. discloses an adjustable rotating resistance exerciser. The Froelich, Sr. et al. patent includes a handle those rotating resistance may be adjusted by rotating an adjustment knob. Patent application no. 2006/0189452 to Chou discloses a magnetic resistance device for upright bikes. The Chou patent application includes a magnetic resistance upright bike with a frame, driving wheel, a fly wheel and a magnetic resistance device. The driving wheel is used to rotate the fly wheel, which is disposed in the magnetic resistance device. Rotation of the fly wheel is resisted by the magnetic resistance device.

Accordingly, there is a clearly felt need in the art for a forearm and wrist exercise device that includes a handle rod with adjustable rotating resistance and smooth rotation.

SUMMARY OF THE INVENTION

The present invention provides a forearm and wrist exercise device, which builds muscle mass by rotation of a pair of handles. The forearm and wrist exercise device (exercise device) preferably includes a base frame, a handle rod, a driver wheel, a driven yoke, a driven wheel and an adjustable tensioner. The base frame is attached to a stationary object, such as a wall. The driver wheel is attached to the handle rod and the handle rod is pivotally retained by the base frame. One end of the driven yoke is pivotally retained by the base frame and the driven wheel is pivotally retained in the other end. The driven wheel is forced against the driver wheel with the adjustable tensioner. Increasing the force against the driver wheel with the adjustable tensioner, increases the effort required to rotate the handle rod.

A second embodiment of the exercise device preferably includes a base frame, a handle rod, a driver wheel, a tension belt and an adjustable tensioner. The base frame is attached to a stationary object, such as a wall. The driver wheel is attached to the handle rod and the handle rod is pivotally retained by the base frame. The tension belt is wrapped around the driver wheel. The adjustable tensioner is retained in a top of the base frame. A first end of the tension belt is attached to the adjustable tensioner. One end of an extension spring is attached to a second end of the tension belt and the other end is attached to the base frame. Tightening the tension belt against the driver wheel with the adjustable tensioner increases the effort required to rotate the handle rod.

A third embodiment of the exercise device preferably includes a base frame, a hydraulic pump, a hydraulic flow valve and a pair of extension shafts. The base frame is attached to a stationary object, such as a wall. The hydraulic pump is attached to the base frame. The hydraulic pump includes a drive shaft, which extends from opposing sides thereof. A single extension shaft is attached to each end of the drive shaft with a shaft coupler or the like. The hydraulic pump also includes a hydraulic oil input and a hydraulic oil output. A first hydraulic line is connected between one inlet of the hydraulic flow valve and the hydraulic oil input and a second hydraulic line is connected between the other inlet of the hydraulic flow valve and the hydraulic oil output. Decreasing the flow area in the hydraulic flow valve, increases the effort required to rotate the pair of extension shafts.

A fourth embodiment of the exercise device preferably includes a base frame, a handle rod, a driver gear, a driven gear, a flywheel and an electromagnet. The base frame is attached to a stationary object, such as a wall. The driver gear is attached to the handle rod. The handle rod is pivotally retained by the base frame. The driven gear and flywheel are retained on a driven rod. The driven rod is rotatably retained by the base frame. The electromagnet includes a first magnet, a second magnet and a mounting plate. The first magnet is attached to the mounting plate and the second magnet is attached to the mounting plate, adjacent the first magnet, such that a gap is created between the first and second magnets to receive a thickness of the flywheel. The mounting plate is attached to the base frame. A current control box is used to vary the electrical current supplied to the first and second magnets. Increasing the electrical current flow through the first and second magnets, increases the effort required to rotate the handle rod.

Accordingly, it is an object of the present invention to provide an exercise device with adjustable rotating resistance to provide a smooth forearm and wrist exercise.

These and additional objects, advantages, features and benefits of the present invention will become apparent from the following specification.

DETAILED DESCRIPTION OF THE PREFERRED EMBODIMENTS

Figure 1:
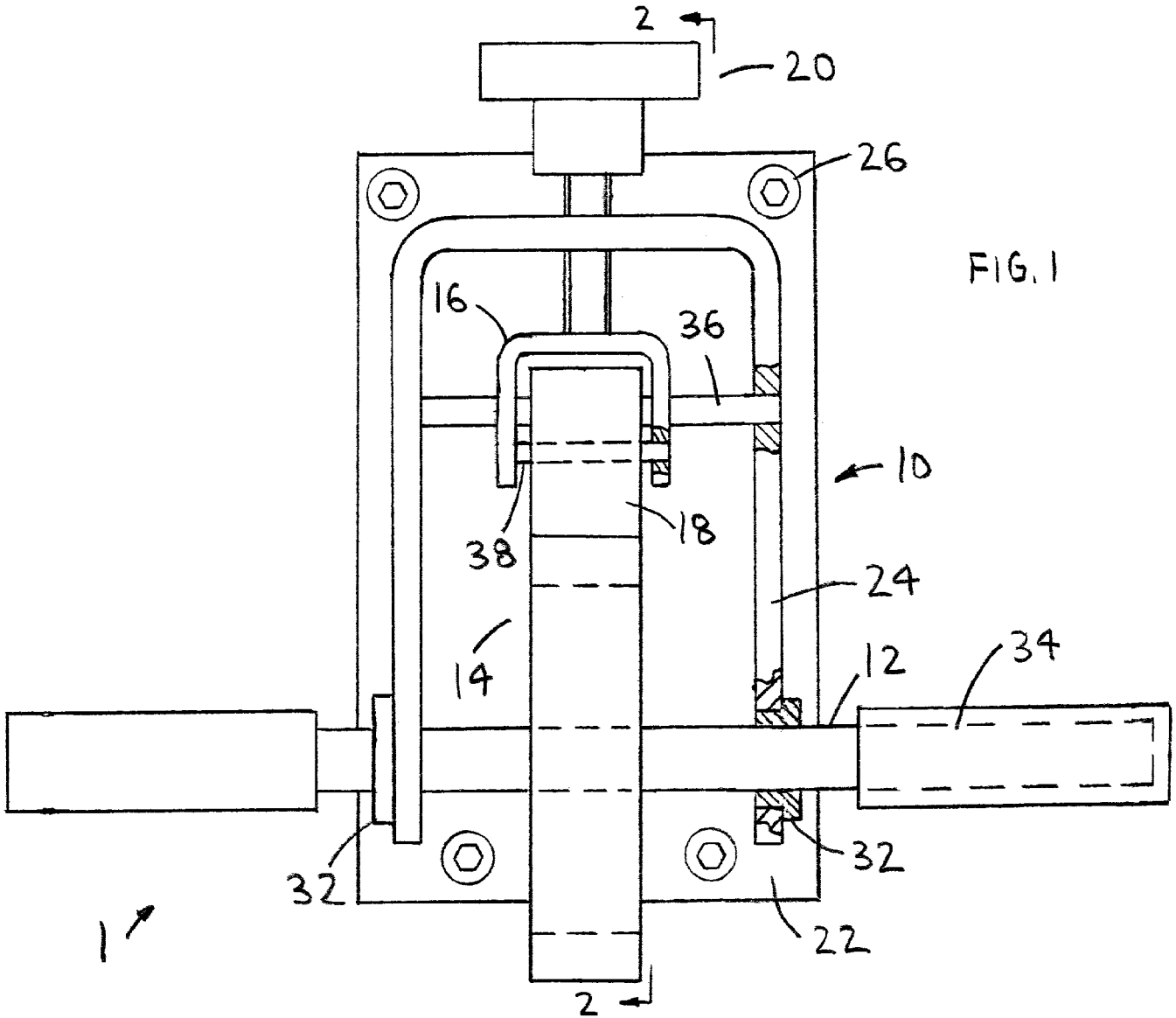
FIG. 1 is a front view of an exercise device in accordance with the present invention.
Figure 2:
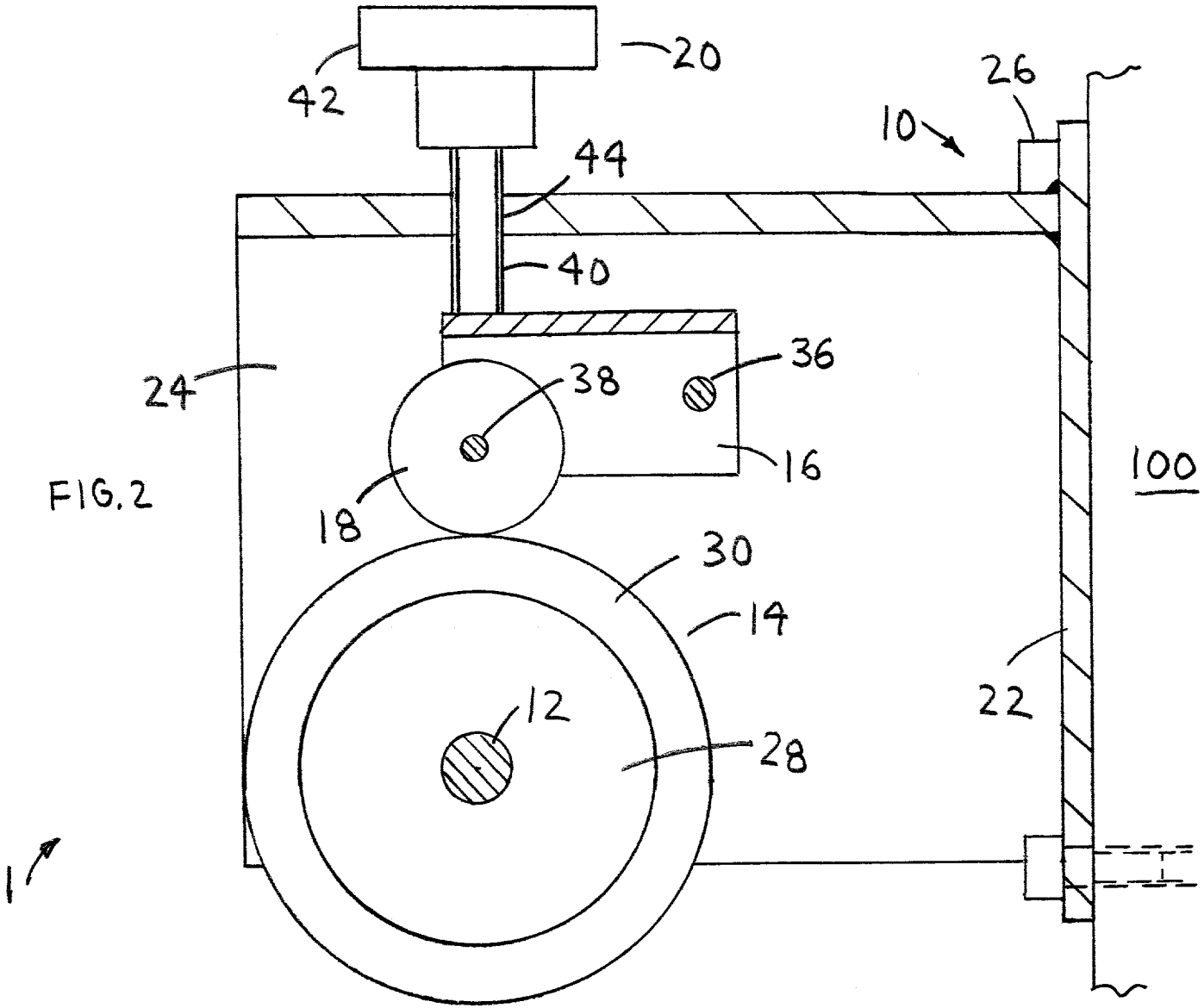
FIG. 2 is a side cross-sectional view of an exercise device in accordance with the present invention.

With reference now to the drawings, and particularly to FIG. 1, there is shown a front view of an exercise device 1. With reference to FIG. 2, the exercise device 1 preferably includes a base frame 10, a handle rod 12, a driver wheel 14, a driven yoke 16, a driven wheel 18 and an adjustable tensioner 20. The base frame 10 includes a mounting plate 22 and a wheel yoke 24. An end of the wheel yoke 24 is attached to the mounting plate 22 with any suitable process. The mounting plate 22 is attached to a stationary object, such as a wall 100 with fasteners 26 or the like. The driver wheel 14 includes a base diameter 28 and an outer layer 30. The base diameter 28 is preferably fabricated from a rigid material, such as metal and the outer layer 30 is preferably fabricated from a resilient material, such as rubber.

The base diameter 28 is rigidly attached to the handle rod 12 with any suitable process. A pair of bearings 32 are preferably inserted into opposing sides of the wheel yoke 24. Each bearing 32 is sized to receive an end of the handle rod 14. A hand grip 34 is preferably pressed on to each end of the handle rod 12. The driven yoke 16 is pivotally retained by the wheel yoke 24 by inserting a pivot rod 36 through holes in one end of the driven yoke 16 and the wheel yoke 24. The driven wheel 18 is pivotally retained by inserting a wheel rod 38 through holes in opposing sides of the driven yoke 16 at the other end thereof. The adjustable tensioner 20 includes a threaded shaft 40 extending from an end of a turn knob 42. A threaded hole 44 is formed through a top of the wheel yoke 24, adjacent the other end of the driven yoke 16. The threaded hole 44 is sized to threadably receive the threaded rod 40. The turn knob 42 is rotated to force the driven wheel 18 against the driver wheel 14. Increasing the force against the driver wheel 14 with the adjustable tensioner 20, increases the effort required to rotate the handle rod 12.

Figure 3:
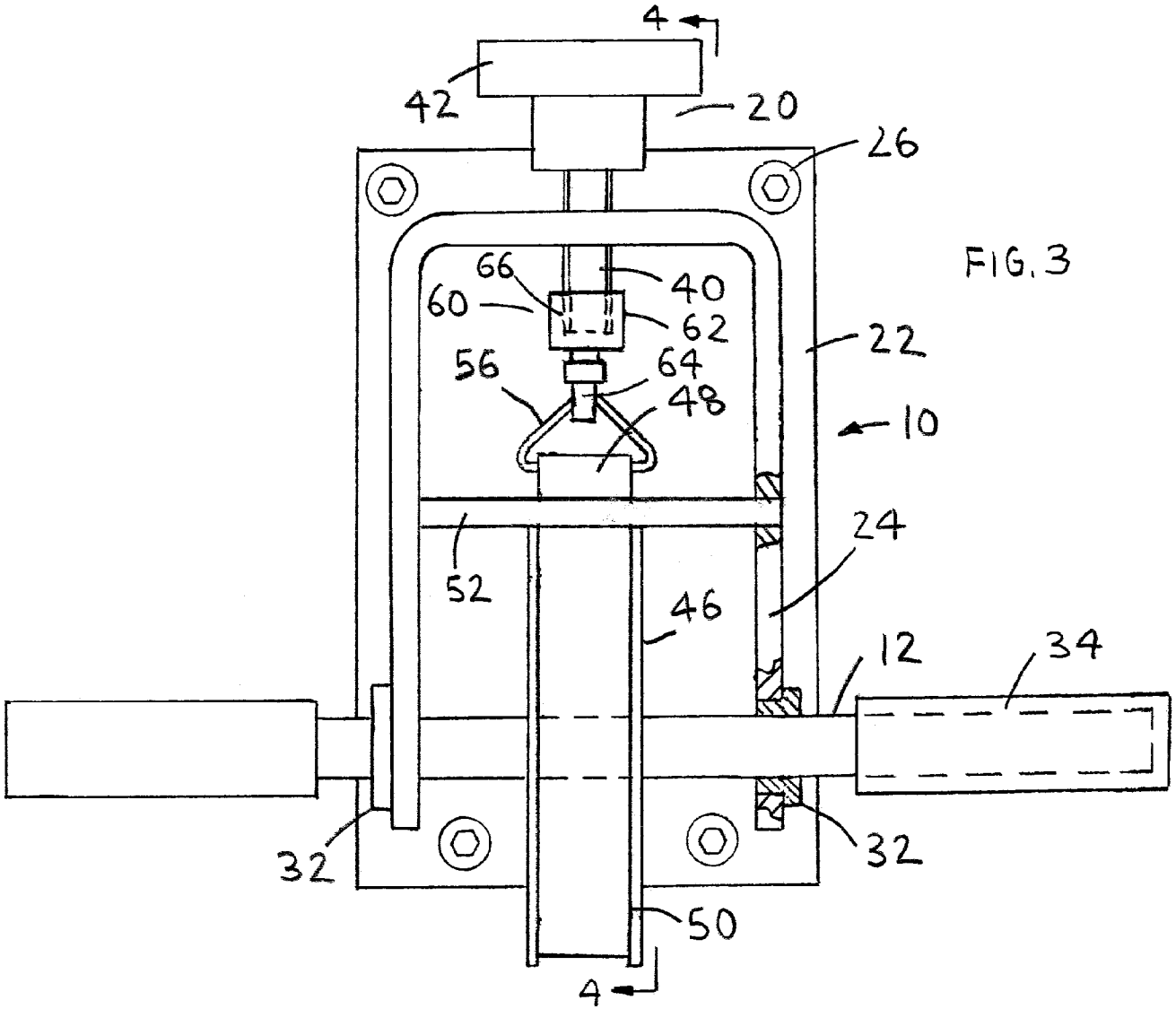
FIG. 3 is a front view of a second embodiment of an exercise device in accordance with the present invention.
Figure 4:
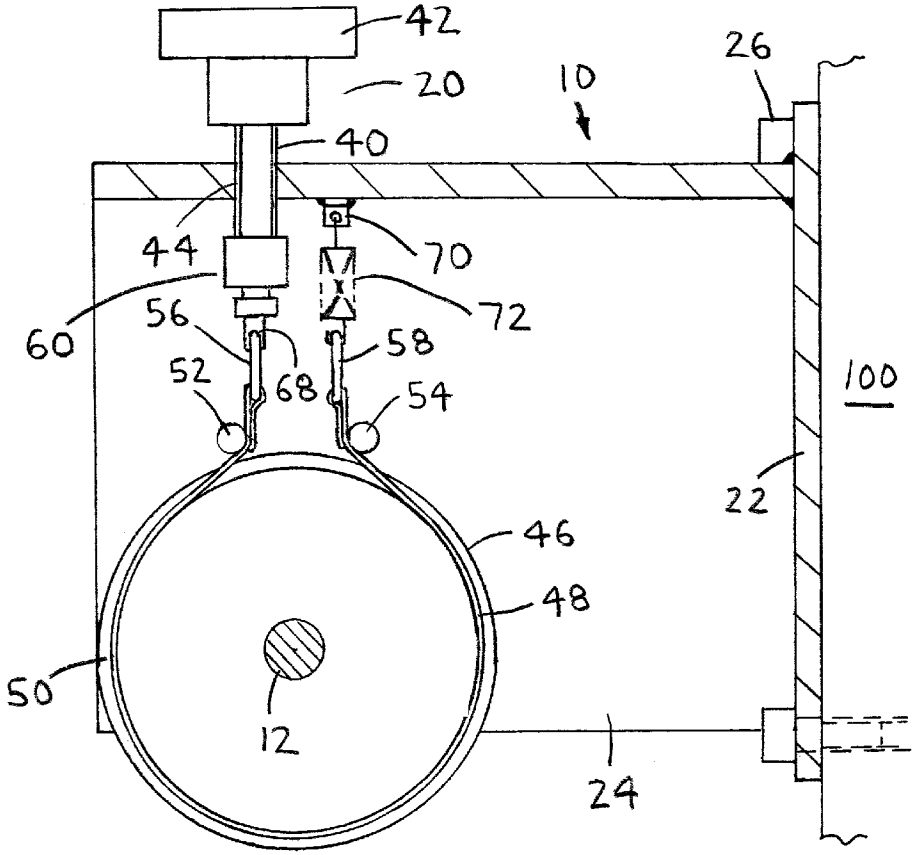
FIG. 4 is a side cross-sectional view of a second embodiment of an exercise device in accordance with the present invention.

With reference to FIGS. 3-4, a second embodiment of the exercise device 2 preferably includes the base frame 10, the handle rod 14, a driver wheel 46, a tension belt 48 and the adjustable tensioner 20. The mounting plate 22 is attached to a stationary object, such as the wall 100 with fasteners 26 or the like. The driver wheel 46 includes a belt groove 50 formed in a perimeter thereof. The belt groove 50 is sized to receive a width of the tension belt 48. The belt groove 50 prevents the tension belt 48 from slipping off the driver wheel 46. A first belt rod 52 is inserted into holes formed through opposing sides of the wheel yoke 24. A second belt rod 54 is inserted into holes formed through opposing sides of the wheel yoke 24. The first and second belt rods ensure that the tension belt 48 makes maximum contact with the driver wheel 46. A first clip 56 is preferably retained on a first end of the tension belt 48 by folding over the first end of the tension belt 48 and attaching thereof to itself. A second clip 58 is preferably retained on a second end of the tension belt 48 by folding over the second end of the tension belt 48 and attaching thereof to itself.

A swivel clip retainer 60 includes a threaded portion 62 and a clip portion 64. The threaded portion 62 is rotatably engaged with the clip portion 64. Swivel devices are well known in the art and need not be explained in detail. A female thread 66 formed in the threaded portion 62 is sized to threadably receive the threaded shaft 40. A clip opening 68 is formed through the clip portion 62 to receive the first clip 56. The first clip 56 is split to allow thereof to be inserted into the clip opening 68. A spring bracket 70 is attached to a top of the wheel yoke 24 with any suitable method. One end of an extension spring 72 is attached to the second clip 58 and the other end of the extension spring 72 is inserted into an opening in the spring bracket 70.

The driver wheel 46 is rigidly attached to the handle rod 14 with any suitable process. The pair of bearings 32 are preferably inserted into opposing sides of the wheel yoke 24. A single hand grip 34 is preferably pressed on to each end of the handle rod 14. The turn knob 42 is rotated to increase the tension of the tension belt 48 against the driver wheel 46. Increasing the tension against the driver wheel 14 with the adjustable tensioner 20, increases the effort required to rotate the handle rod 12.

Figure 5:
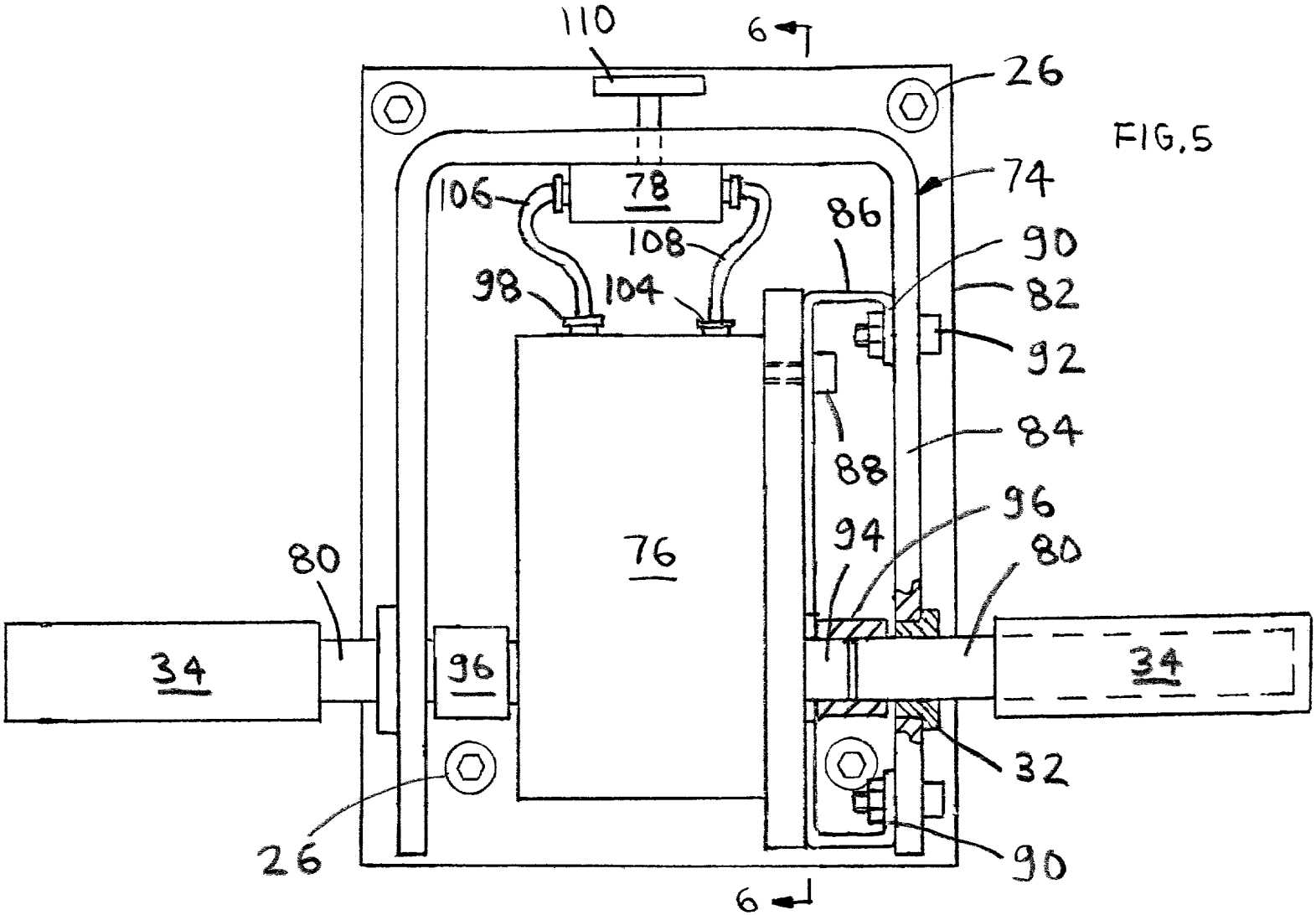
FIG. 5 is a front view of a third embodiment of an exercise device in accordance with the present invention.
Figure 6:
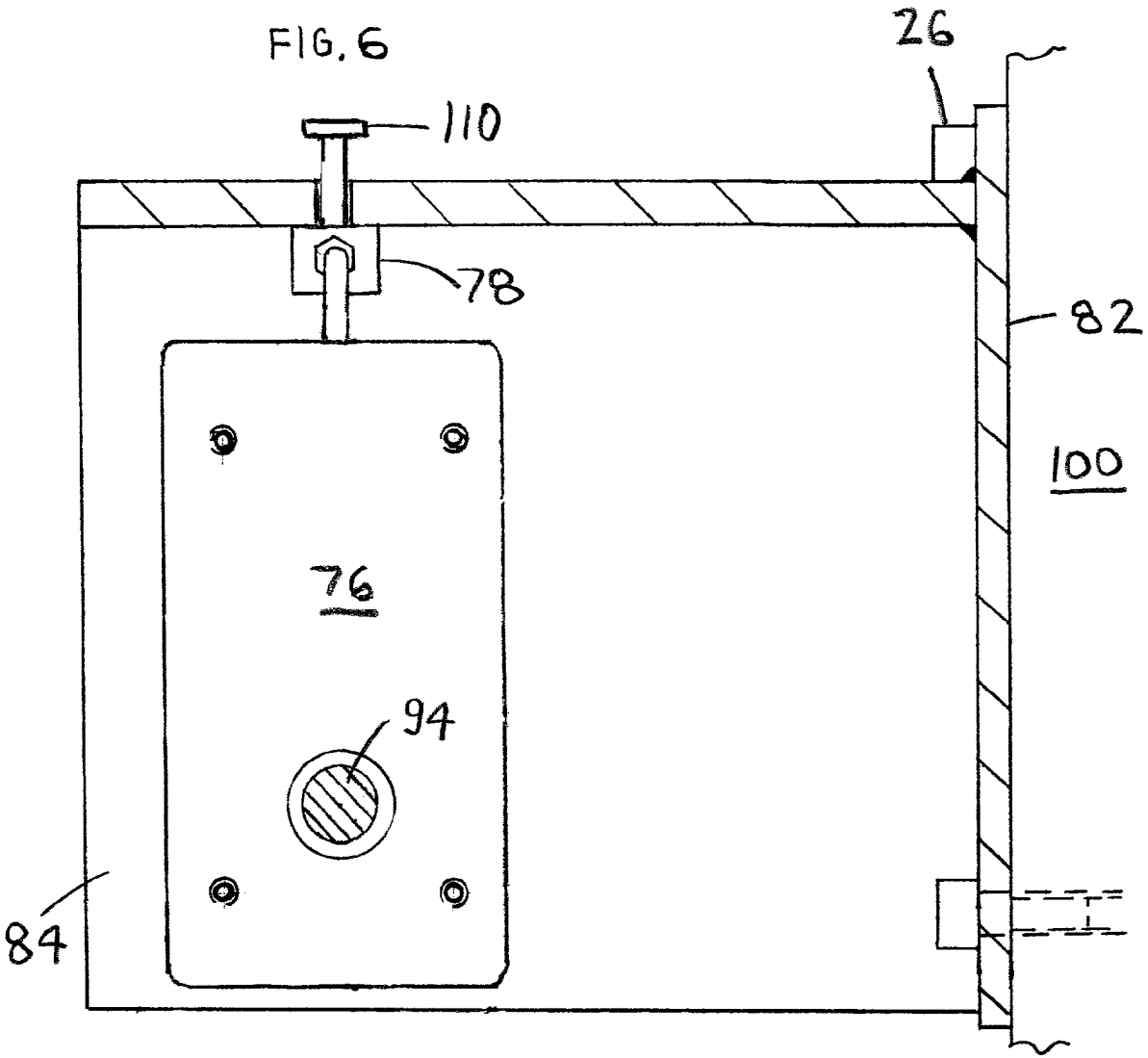
FIG. 6 is a side cross-sectional view of a third embodiment of an exercise device in accordance with the present invention.

With reference to FIGS. 5-6, a third embodiment of the exercise device 2 includes a base frame 74, a hydraulic pump 76, a hydraulic flow valve 78 and a pair of extension shafts 80. The base frame 74 includes a mounting plate 82 and a pump yoke 84. An end of the pump yoke 84 is attached to the mounting plate 82 with any suitable process. The mounting plate 82 is attached to a stationary object, such as the wall 100 with fasteners 26 or the like. The hydraulic pump 76 is preferably mounted to a spacer plate 86 with at least two fasteners 88. Two support feet 90 preferably extend from each side of the spacer plate 86. The two support feet 90 are attached to a side of the pump yoke 84 with at least two fasteners 92.

The hydraulic pump 76 includes a drive shaft 94, which extends from opposing sides thereof. A single extension shaft 80 is attached to each end of the drive shaft 94 with a shaft coupler 96 or the like. The pair of bearings 32 are preferably inserted into opposing sides of the pump yoke 84. Each bearing 32 is sized to receive a single extension shaft 80. The hand grip 34 is preferably pressed on to each extension shaft 80. The hydraulic pump 76 also includes a hydraulic oil input 98 and a hydraulic oil output 104. The hydraulic flow valve 78 is attached to a top of the pump yoke 84 with any suitable method. A first hydraulic line 106 is connected between one inlet of the hydraulic flow valve 78 and the hydraulic oil input 98 and a second hydraulic line 104 is connected between the other inlet of the hydraulic flow valve 78 and the hydraulic oil output 104. Rotating a handle 110 of the hydraulic flow valve 78 restricts the flow therethrough and increases the effort required to rotate the pair of extension shafts 80.

Figure 7:
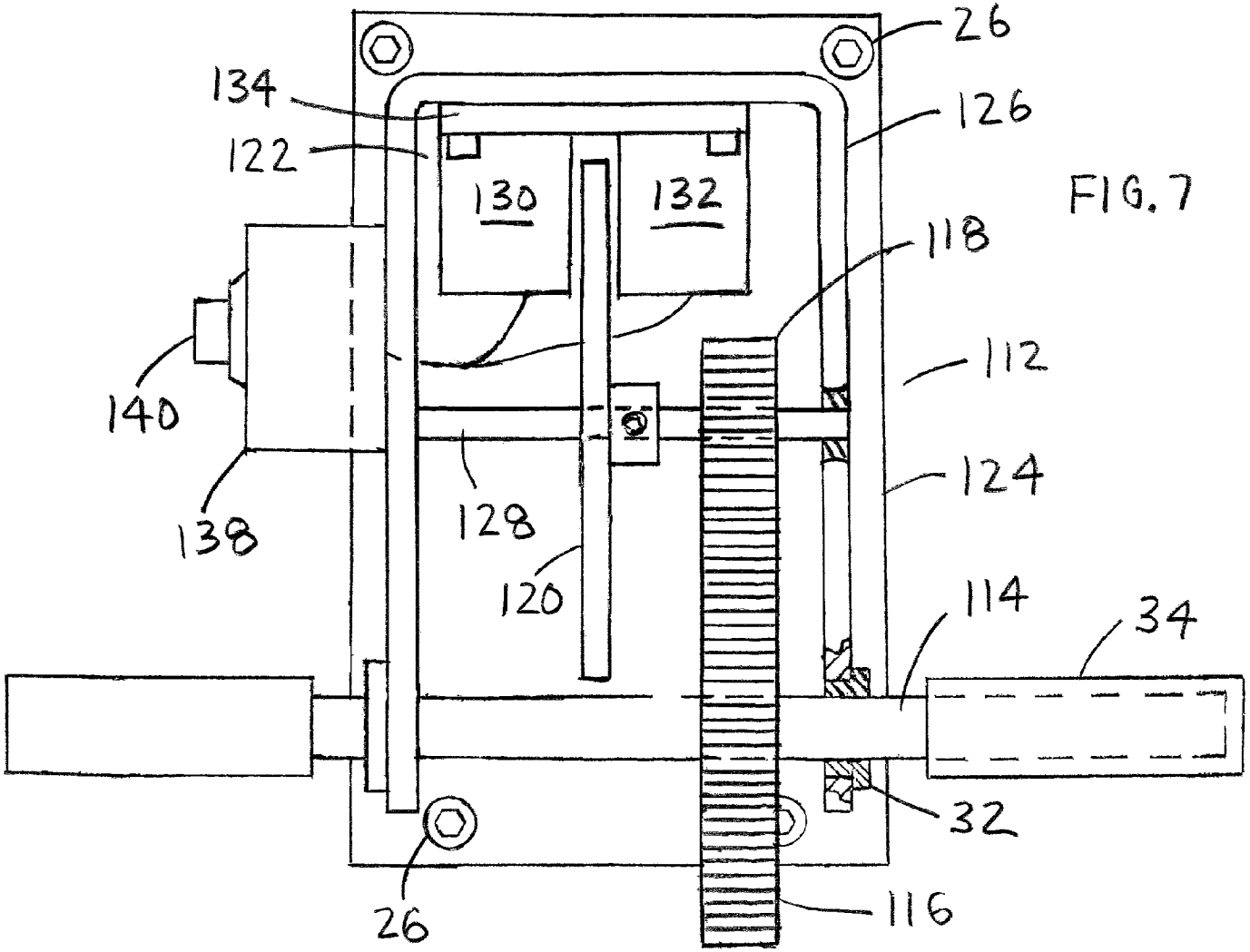
FIG. 7 is a front view of a fourth embodiment of an exercise device in accordance with the present invention.
Figure 8:
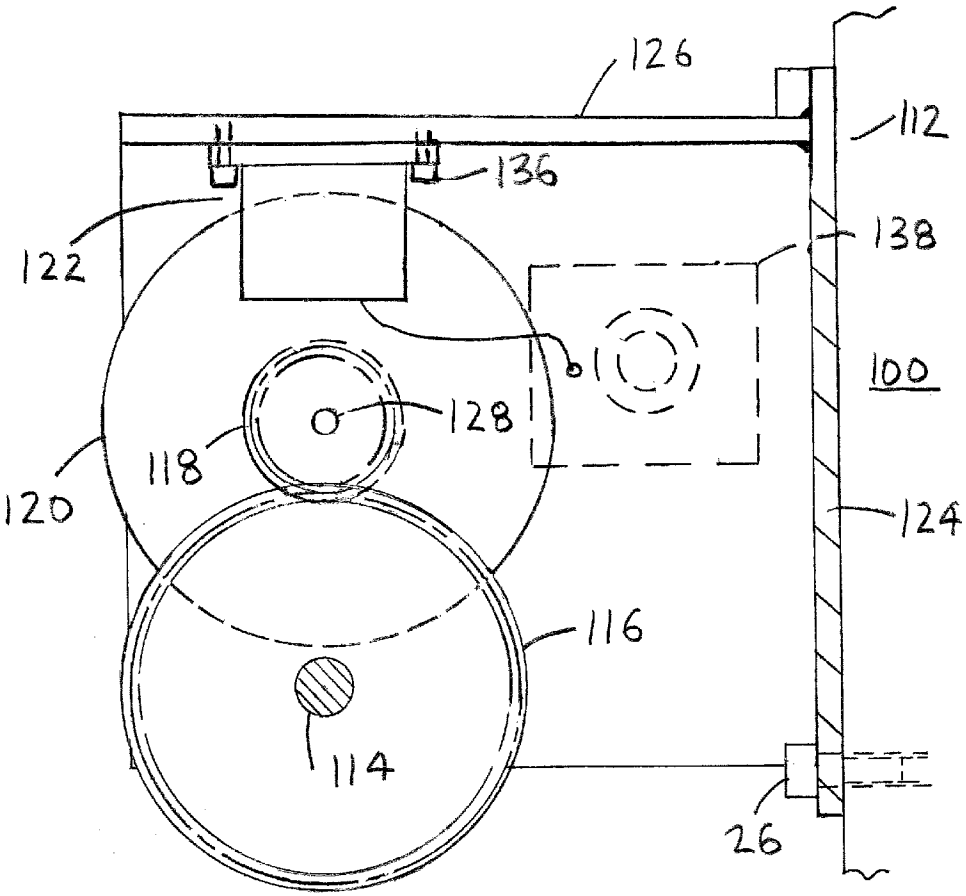
FIG. 8 is a side cross-sectional view of a fourth embodiment of an exercise device in accordance with the present invention.

With reference to FIGS. 7-8, an exercise device 4 preferably includes the base frame 112, a handle rod 114, a driver gear 116, a driven gear 118, a flywheel 120 and an electromagnet 122. The base frame 112 includes a mounting plate 124 and a gear yoke 126. The gear yoke 126 is attached to the mounting plate 124 with welding or any other suitable process. The gear yoke 126 has a substantial U-shape. The mounting plate 124 is attached to a stationary object, such as the wall 100 with fasteners 26 or the like. The driver gear 116 is rigidly attached to the handle rod 114 with any suitable process. The pair of bearings 32 are preferably inserted into opposing sides of the gear yoke 126. Each bearing 32 is sized to receive an end of the handle rod 14. A hand grip 34 is preferably pressed on to each end of the handle rod 12. The driven gear 118 and the flywheel 120 are rigidly attached to a driven rod 128. The driven rod 128 is rotatably retained by the gear yoke 126.

The electromagnet 122 includes a first magnet 130, a second magnet 132 and a mounting plate 134. The first magnet 130 is attached to the mounting plate 134 and the second magnet 132 is attached to the mounting plate 134, adjacent the first magnet 130, such that a gap is created between the first and second magnets to receive a thickness of the flywheel 120. The mounting plate 134 is attached to the gear yoke 126 with fasteners 136 or the like. A current control box 138 is used to vary the electrical current supplied to the first and second magnets. The electrical current flow to the first and second magnets is preferably varied by rotation of a knob 140. Electromagnets and electrical current limiting are well known in the art and need not be explained in further detail. An increase in electrical current flow increases the strength of the first and second magnets, which increases the effort required to rotate the handle rod 114.

A case is preferably created to cover the moving elements of the first, second, third or fourth exercise devices for safety and appearance purposes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A device for exercising forearms and wrists of a user, comprising:

a base frame;

a handle rod having a pair of hand grips at each end and being rotatably retained in said base frame;

a driver gear being axially retained on said handle rod;

a driven gear being attached to a driven rod, said driven rod being rotatably retained in said base frame, said driven gear engaging said driver gear and being driven thereby;

a flywheel being attached to said driven rod adjacent said driven gear; and a first electromagnet being located on one side of said flywheel, a second electromagnet being located on the other side of said flywheel, wherein electric current flows through said first and second electromagnets for providing resistance to the rotation of said flywheel wherein the user's hands remain generally coaxial with the handle rod during exercise.

2. The device for exercising forearms and wrists of a user of claim 1, further comprising:

a current control box for varying the amount of electrical current supplied to said first and second electromagnets.

3. The device for exercising forearms and wrists of a user of claim 1, further comprising:

said base frame including a gear yoke and a mounting plate, said gear yoke being attached to said mounting plate.

4. The device for exercising forearms and wrists of a user of claim 1, further comprising:

a hand grip being attached to each end of said handle rod.

5. The device for exercising forearms and wrists of a user of claim 1, further comprising:

a bearing being inserted into opposing sides of said gear yoke, an inner diameter of said bearing being sized to rotatably receive said handle rod.

6. A device for exercising forearms and wrists of a user, comprising:

a base frame including a gear yoke attached to a mounting plate;

a handle rod having a pair of hand grips at each end and being rotatably retained in said gear yoke;

a driver gear being axially retained on said handle rod;

a driven gear being attached to a driven rod, said driven rod being rotatably retained in said gear yoke, said driven gear engaging said driver gear and being driven thereby;

a flywheel being attached to said driven rod adjacent said driven gear; and a first electromagnet being located on one side of said flywheel, a second electromagnet being located on the other side of said flywheel, wherein electric current flows through said first and second electromagnets for providing resistance to the rotation of said flywheel wherein the user's hands remain generally coaxial with the handle rod and engage each rod end during exercise.

7. The device for exercising forearms and wrists of a user of claim 6, further comprising:

a current control box for varying the amount of electrical current supplied to said first and second electromagnets.

8. The device for exercising forearms and wrists of a user of claim 6, further comprising:

a hand grip being attached to each end of said handle rod.

9. The device for exercising forearms and wrists of a user of claim 6, further comprising:

a bearing being inserted into opposing sides of said gear yoke, an inner diameter of said bearing being sized to rotatably receive said handle rod.

10. A device for exercising forearms and wrists of a user, comprising:

a base frame;

a handle rod having a pair of hand grips at each end and being rotatably retained in said base frame;

a driver gear being axially retained on said handle rod;

a driven gear being attached to a driven rod, said driven rod being rotatably retained in said base frame, said driven gear engaging said driver gear and being driven thereby;

a flywheel being attached to said driven rod adjacent said driven gear;

a first electromagnet being located on one side of said flywheel, a second electromagnet being located on the other side of said flywheel, wherein electric current flows through said first and second electromagnets for providing resistance to the rotation of said flywheel wherein the user's hands remain generally coaxial with the handle rod during exercise; and a current control box for varying the amount of electrical current supplied to said first and second electromagnets.

11. The device for exercising forearms and wrists of a user of claim 10, further comprising:

said base frame including a gear yoke and a mounting plate, said gear yoke being attached to said mounting plate.

12. The device for exercising forearms and wrists of a user of claim 10, further comprising:

a hand grip being attached to each end of said handle rod.

13. The device for exercising forearms and wrists of a user of claim 10, further comprising:

a bearing being inserted into opposing sides of said gear yoke, an inner diameter of said bearing being sized to rotatably receive said handle rod.

* * * * *